US006520225B1

(12) United States Patent
Dembicks

(10) Patent No.: US 6,520,225 B1
(45) Date of Patent: Feb. 18, 2003

(54) GUIDE FOR A TOOL

(75) Inventor: Tyler J. Dembicks, Raleigh, FL (US)

(73) Assignee: Andrews Toolworks, Inc., Raleigh, NC (US)

( * ) Notice: Subject to any disclaimer, the term of this patent is extended or adjusted under 35 U.S.C. 154(b) by 0 days.

(21) Appl. No.: 10/056,834

(22) Filed: Jan. 25, 2002

(51) Int. Cl.[7] ..... B27C 5/02

(52) U.S. Cl. ..... 144/253.5; 144/253.1; 144/253.2; 144/135.2

(58) Field of Search ..... 83/467.1, 468.7, 83/477.2, 468.2, 488.1; 33/636, 638; 144/253.1, 253.2, 253.5, 135.2; 269/303, 304, 315, 318

(56) References Cited

U.S. PATENT DOCUMENTS

| | | | | |
|---|---|---|---|---|
| 727,337 A | | 5/1903 | Forster | |
| 1,664,969 A | | 4/1928 | Conover | |
| 1,947,885 A | | 2/1934 | Tautz | |
| 2,104,158 A | | 1/1938 | Hedgpeth | |
| 3,884,094 A | * | 5/1975 | Ulmer | 144/253.5 |
| 4,114,665 A | | 9/1978 | Decker | |
| 4,719,951 A | | 1/1988 | Woltanski | |
| 4,787,614 A | | 11/1988 | Givens | |
| 5,016,693 A | | 5/1991 | Haffely et al. | |
| 5,042,542 A | | 8/1991 | Purviance | |
| 5,452,752 A | * | 9/1995 | Algner | 144/253.6 |
| 5,908,061 A | | 6/1999 | Blichmann | |
| 6,134,800 A | | 10/2000 | Newman | |
| 6,293,177 B1 | | 9/2001 | MacKenzie | |

* cited by examiner

*Primary Examiner*—W. Donald Bray
(74) *Attorney, Agent, or Firm*—Akerman Senterfitt

(57) ABSTRACT

A guide for a tool such as a router includes a support structure attachable to a table and having a mounting surface. A fence portion such as a rectangular fence block is coupled to said mounting surface for guiding a workpiece to and from the tool. An adjustment structure is included for positioning the fence portion at one of a plurality of predetermined distances from the mounting surface. At least one coupling couples the fence part to the mounting surface, and holds the fence portion at the predetermined distance from the mounting surface.

41 Claims, 5 Drawing Sheets

GUIDE FOR A TOOL

CROSS-REFERENCE TO RELATED APPLICATIONS

Not applicable.

STATEMENT REGARDING FEDERALLY-SPONSORED RESEARCH

Not applicable.

BACKGROUND OF THE INVENTION

1. Field of the Invention

This invention relates generally to a guide for a tool, and more particularly relates to a guide fence for a router and other similar tools.

2. Description of the Related Art

Guide fences are used with tools such as routers and saws to guide a workpiece such as a block of wood while the workpiece is cut or otherwise worked by the tool. Typically such fences are divided into separate portions, including an in-feed fence portion and an out-feed fence portion. A tool is generally placed between the two fence portions. Work is performed on the workpiece such as trimming the workpiece by removing a surface layer. During this operation, the workpiece may move back and forth, or seesaw, as the workpiece is trimmed or cut due to the unevenness in shape between the portion of the workpiece that has already been trimmed, and the untrimmed portion. As a result, the workpiece can be pulled further into the tool, resulting in inaccurate cutting, and possible damage to the workpiece.

It is known to alter the placement of out-feed fence portions, in order to prevent this seesawing action. For example, U.S. Pat. No. 1,664,969 to Conover describes a guide fence having a wedge shape that may be moved along an angled plate using an adjusting screw located at the blunt end of the wedge in order to push the forward surface of the guide fence outwardly. U.S. Pat. No. 1,947,885 to Tautz discloses an adjustable guide fence having an adjusting screw which operates to laterally move a generally rectangular guide fence. Similar concepts are described in U.S. Pat. No. 2,104,158 to Hedgpeth, U.S. Pat. No. 4,719,951 to Woltanski, U.S. Pat. No. 4,787,614 to Givens, and U.S. Pat. No. 5,908,061 to Blichmann.

Known adjustable guide fences require careful measurement of the amount of the workpiece to be worked and careful consideration of the required position of the guide fence. Satisfying these requirements can be time consuming, and the chances of making an error in positioning can be great. For example, if the guide fence is set too far forward, it can obstruct the movement of the workpiece, whereas if it is set too far back, the problem of seesawing of the workpiece returns. Often, a user must perform an iterative series of adjustments using a test workpiece in order to insure that the guide fence is correctly positioned.

In addition, known adjustable guide fences are only held in position by the adjusting screw that is used to adjust the positioning of the fence. Over time, vibration and wear to the adjusting screw can cause the screw to loosen slightly, causing movement of the guide fence in use.

SUMMARY OF THE INVENTION

One aspect of the invention relates to a guide for a tool. The guide includes a support structure having at least one mounting surface. A fence portion is coupled to the mounting surface. An adjustment structure for positioning the fence portion at one of a plurality of predetermined distances from the mounting surface is also included. At least one coupling is included for coupling the fence portion to the mounting surface and for holding the fence portion at the predetermined distance from the mounting surface.

The adjustment structure and coupling enable the fence portion to be incrementally moved to a predetermined distance from the mounting surface, and to be firmly held in position. The guide can thus be easily set, and is reliable in use.

Another aspect of the invention relates to a guide for a tool including a support structure having at least one mounting surface. An in-feed fence portion is coupled to the mounting surface for guiding a workpiece to the tool. An out-feed fence portion is coupled to the mounting surface for guiding the workpiece from the tool. Also included is an adjustment structure for positioning the out-feed fence portion at one of a plurality of predetermined distances from the mounting surface. A coupling structure is included for coupling the fence portions to the mounting surface and for holding the out-feed fence portion at the predetermined distance from the mounting surface.

A further aspect of the invention relates to a work table for a tool, the work table having a guide fence including a support structure attached to the work table and having a mounting surface. An in-feed fence portion is coupled to said mounting surface for guiding a workpiece to the tool. An out-feed fence portion is coupled to the mounting surface for guiding a workpiece from the tool. An adjustment structure is included for positioning the out-feed fence portion at one of a plurality of predetermined distances from the mounting surface. Coupling structures are provided for coupling the fence portions to the mounting surface and for holding the out-feed fence portion at the predetermined distance from the mounting surface.

Another aspect of the invention relates to an adjustment structure for a guide for a tool, the guide having a mounting surface and a fence portion. The adjustment structure includes an adjustment block for insertion between the mounting surface and the fence portion. The adjustment block has adjustment structure for positioning the fence portion at one of a plurality of predetermined distances from the mounting surface.

Yet a further aspect of the invention relates to a method of guiding a workpiece from a tool, including providing a support structure and having a mounting surface. A fence portion is coupled to the mounting surface for guiding a workpiece from the tool. An adjustment structure is set in order to position the fence portion at one of a plurality of predetermined distances from the remounting surface. The fence portion is held at the predetermined distance from the mounting surface.

BRIEF DESCRIPTION OF THE DRAWINGS

There are shown in the drawings embodiments which are presently preferred, it being understood, however, that the invention is not limited to the precise arrangements and instrumentality shown, wherein.

DETAILED DESCRIPTION OF THE PREFERRED EMBODIMENTS

Figure 1:
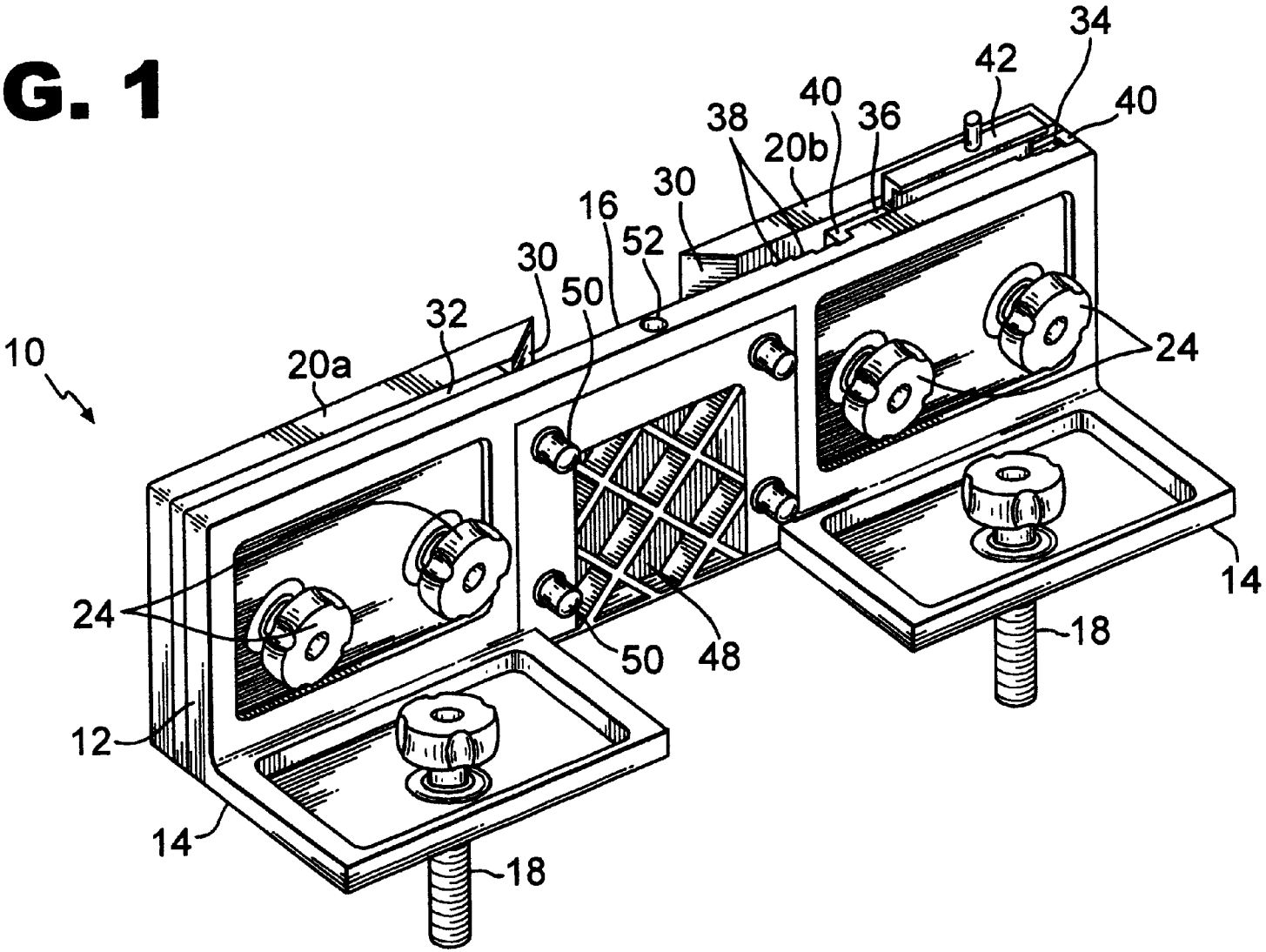
FIG. 1 is a rear perspective view of a guide according to the present invention.
Figure 2:
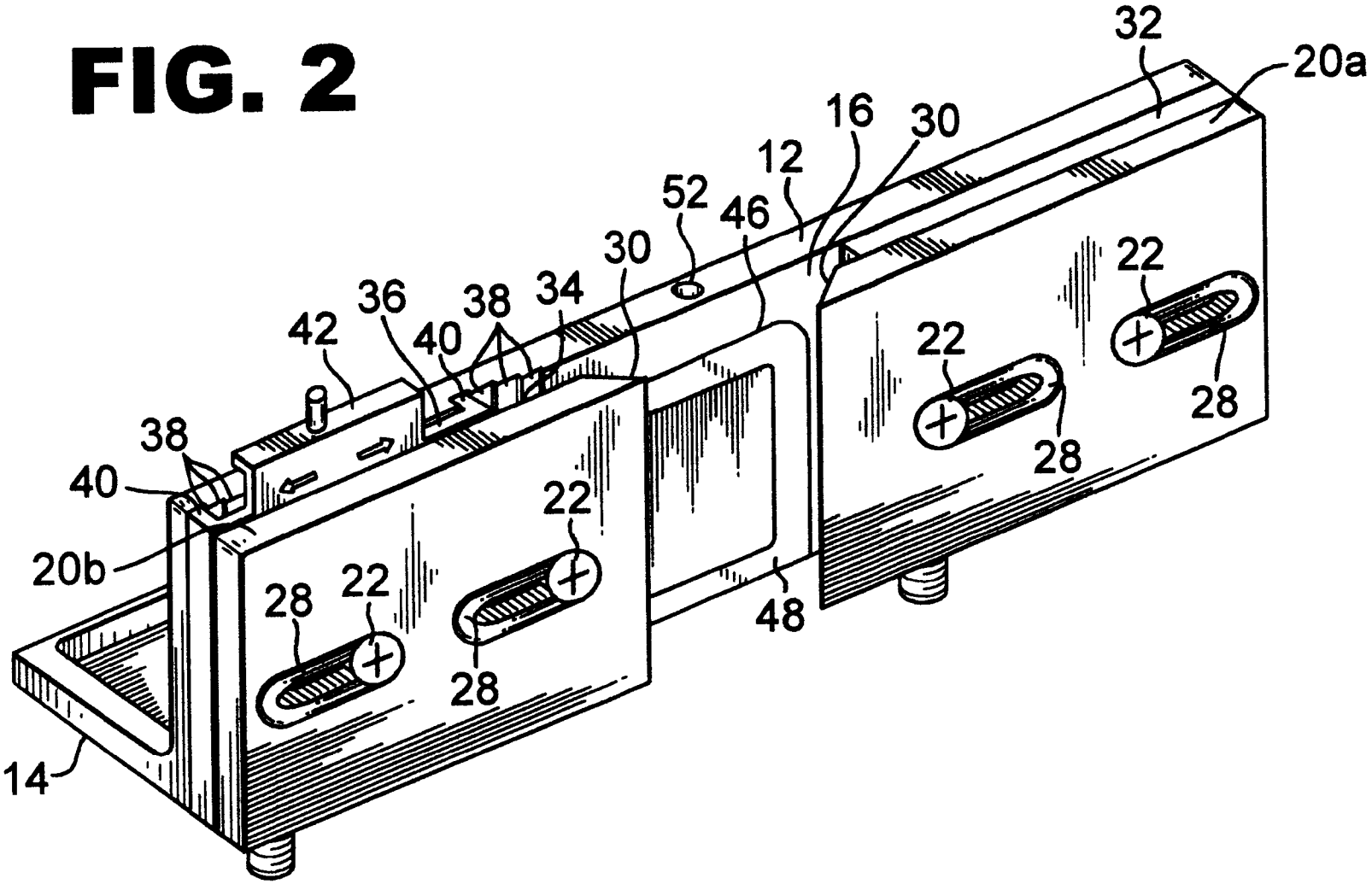
FIG. 2 is a perspective view of a guide according to the present invention.

A guide 10 for a tool according to the invention is shown in FIGS. 1 and 2. The guide has a supporting structure 12. The supporting structure can be any suitable shape. In one arrangement, the supporting structure is L-shaped and includes a first mounting surface 14 and a second mounting surface 16. The first and second mounting surfaces 14, 16 are substantially perpendicular. The first mounting surface 14 can be arranged in any suitable manner, such as horizontally, and can be coupled to a work table by any suitable fastener 18, such as, for example, by means of bolts and nuts. The guide 10 can also include one or more fence blocks 20. The fence blocks 20 can be coupled to the second mounting surface 16 of the supporting structure 12 and can have a rectangular shape. The second mounting surface 16 may be arranged vertically. It should be appreciated that the supporting structure need not be L-shaped and that the fence blocks need not be of a rectangular shape, as any suitable shapes may be used. In addition, the supporting structure may be provided integrally with a work table, rather than separately as in the illustrated embodiment. In one embodiment, the supporting structure 12 may be formed of metal, for example cast aluminum, and the fence blocks 20 may be formed of any suitable material, such as, for example, wood, particle board, or medium density fiberboard. In one arrangement, the guide can contain two fence blocks 20, one of which can be an in-feed fence block 20*a* and the other of which can be out-feed fence block 20*b*. The fence blocks may be coupled to the second mounting surface 16 in any suitable manner, such as by fasteners 22 and fasteners 24. In the illustrated arrangement, two fasteners 22 are used for each fence block 20, the fasteners 22 passing through two apertures 26 in the second mounting surface 16 and two elongated apertures 28 in the fence blocks 20, but the invention is not limited in this regard. The elongated apertures 28 in the fence blocks 20 are countersunk so that heads of fasteners 22 sit flush with the surface of the fence blocks, in order not to damage or obstruct workpieces that are pressed against the fence blocks. The fence blocks 20 may have chamfered inner ends 30 to allow for positioning of a tool between the two fence blocks 20. A spacer plate 32 may be located between the vertical mounting surface 16 and the in-feed fence block 20*a* so that the position of the in-feed fence block 20*a* may be set.

Figure 3:
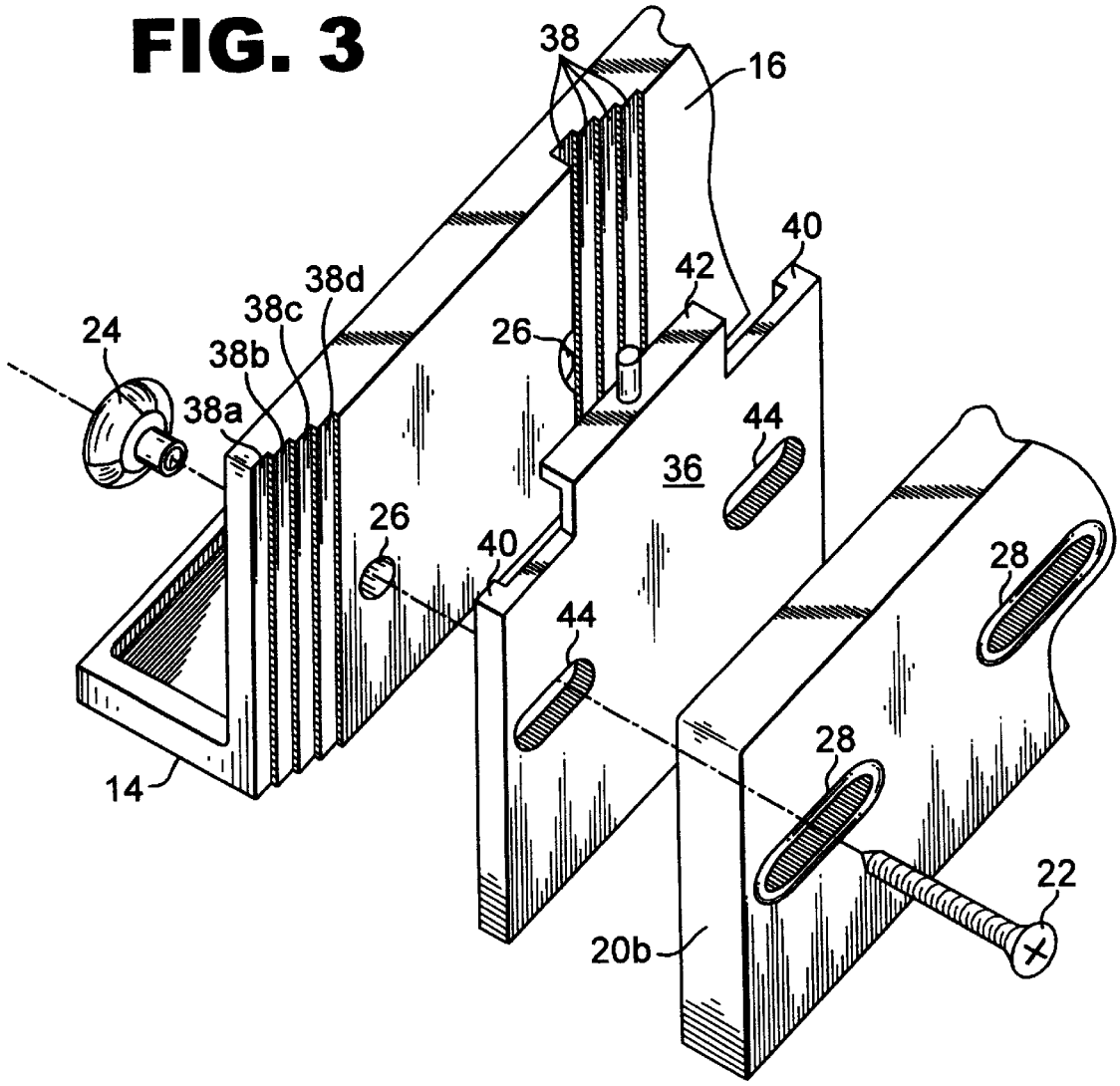
FIG. 3 is a partial exploded front perspective view of the guide of FIG. 1.

A stair step structure 34 can be positioned between the second mounting surface 16 and the out-feed fence block 20*b* for adjusting the position of the out-feed fence block 20*b,* as shown in FIG. 3. The stair step structure 34 can include a rigid adjustment block 36 placed between the fence block 20*b* and the second mounting surface 16. The adjustment block 36 may be of any suitable shape, such as rectangular, and may be formed of metal, for example cast aluminum, or any other suitable material. The stair step structure may also include notches 38 cut into the part of the surface of the second mounting surface 16 that is coupled to the out-feed fence block 20*b*. In the illustrated embodiment, two sets of notches 38 are employed. However, one set or more than two sets of notches per stair step structure may be used. Each notch 38 can have a different pre-determined depth, and the notches can be positioned in ascending or descending order. Thus, for example, if the notches were positioned in ascending order, the first notch 38*a* can be the deepest notch and each successive notch 38*b*–38*d* can be slightly shallower than the preceding notch by a predetermined distance. As such, both sets of notches 38 can have an appearance similar to that of a set of steps. In one arrangement, each notch 38 can increase in height by roughly 1/32 of an inch, as trimming distances are commonly incremented by this particular measurement when blocks of wood are trimmed with certain tools, such as, for example, a router. Different heights of notches can be employed in different embodiments of the invention. For example, the notches may differ in height by 1 mm for use with metric tools, such as routers or cutters. For larger tools, the notches may differ by larger amounts, such as, for example 1/16 of an inch. The depth of the deepest notch 38*a* and the depth of the body of the adjustment block 36 may be set so that the out-feed fence block is positioned at the same distance from the second mounting surface as the in-feed fence block. For example, the depths of the spacer plate 32 for in-feed fence block 20*a* and the adjustment block 36 for out-feed fence block 20*b* may be the same. Alternatively, the dimensions of the components may be set so that the depth of the deepest notch 38*a* and adjustment block 36 causes the out-feed fence block to be positioned one incremental distance, for example, 1/32 of an inch, further forward than the in-feed fence block 20*a,* or at any other distance. The illustrated embodiment includes four notches 38 of varying height, but any number of notches may be used, depending on the intended purpose of the stair step structure.

The adjustment block 36 can also include several notch engaging fins 40, which may be arranged vertically. In one embodiment, the adjustment block 36 has two such vertical notch engaging fins 40 a fixed distance apart in which one fin is attached to one end of the adjustment block, and the other fin is attached to a second end opposite that of the first end. The notch engaging fins 40 can engage a set of notches 38 in the second mounting surface 16. The notch engaging fins 40 can engage corresponding notches 38 of an equivalent height. It should be appreciated, however, that any number of notch sets and notch engaging fins may be provided.

The adjustment block 36 can also include a gripping segment 42. The gripping segment 42 can be on any suitable portion of the adjustment block 36, including the top of the adjustment block 36. The gripping segment 42 can permit a user to slide or otherwise move the adjustment block 36 along the length of the mounting surface 16 that is coupled to the out-feed fence block 20*b,* thereby enabling the notch engaging fins to engage one or more of the notches 38. The adjustment block 36 may also have elongated apertures 44 to receive fasteners 22.

It will be appreciated by persons skilled in the art that the notches 38 may be cut in the adjustment block 36 instead of in the mounting surface 16 as illustrated, and that the mounting surface 16 may be provided with notch engaging fins or other suitable means for engaging the notches.

A cut-out area 46 may be located in the second mounting surface 16, for positioning of the tool. The cut-out area 46 may be closed for storage and transport purposes by a plate 48, which may be of plastic or any other suitable material. The plate 48 can be secured to the second mounting surface 16 by fasteners 50. A threaded aperture 52 may be located in the top of the support structure 12 for securement of a tool. It will be appreciated that it is not necessary to provide both the in-feed and the out-feed fence blocks attached to one mounting surface. Separate mounting surfaces could be provided, for example. Alternatively, the in-feed fence may be an integral part of a work table. For some uses, only an adjustable out-feed fence block may be provided, while for other uses only an adjustable in-feed fence block may be provided. In an alternative arrangement, both an adjustable in-feed fence block and an adjustable out-feed fence block may be used.

Figure 5:
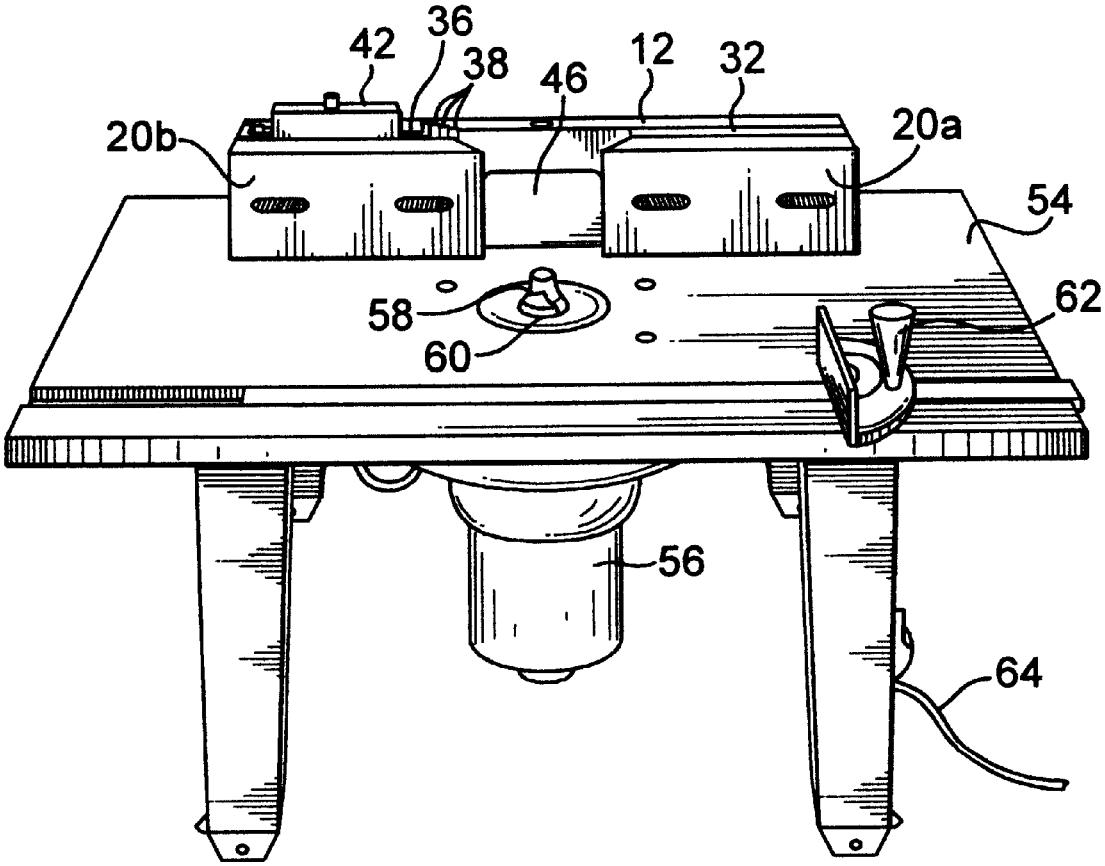
FIG. 5 is a view of a guide according to the present invention with a tool.

According to one embodiment of the invention, and referring to FIG. 5, in operation the user can remove plate 48 from cut-out area 46 of the guide 10 and can secure the guide fence 10 to a work table 54 using fasteners 18. The cut-out area 46 can be located around a tool 56, for example, a router. Alternatively, as shown in FIG. 5, a tool 56 may be secured underneath the table 54 so that a cutting head 58, such as a router bit, can project through an aperture 60 in the table 54. The table 54 may have one or more workpiece guides 62, a power supply 64, and any other suitable accessories. It will be appreciated that the illustrated work table 54 and tool 56 are exemplary only, and that guide 10 may be used with any type of surface on which working of a workpiece is to take place, and that a tool may be used in many different configurations with the guide 10.

Figure 4A:
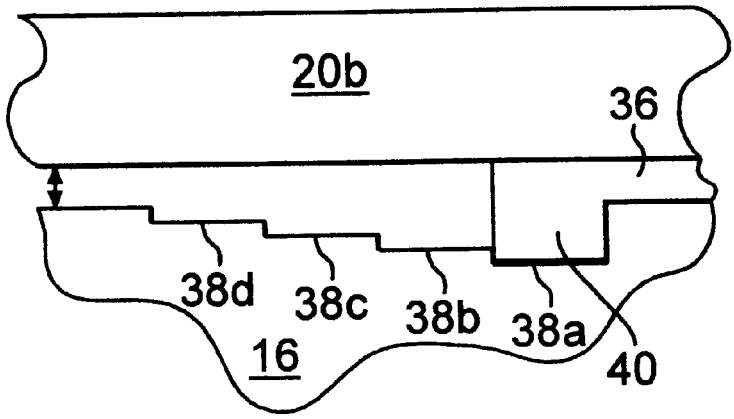
FIG. 4*a* is an end view of part of a guide according to the present invention in a first position.
Figure 4B:
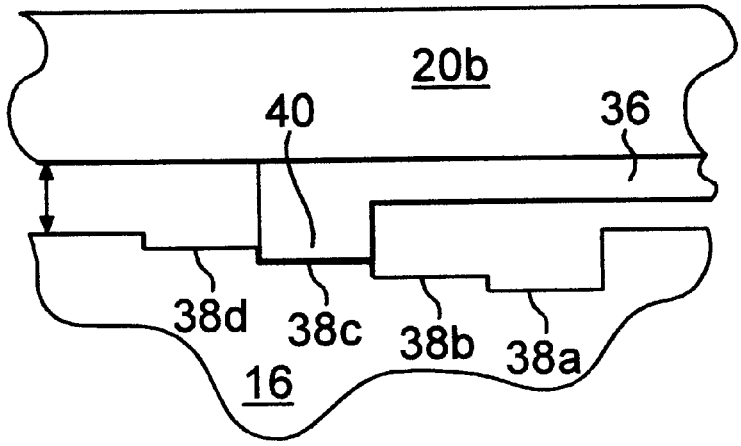
FIG. 4*b* is an end view of the part of the guide shown of FIG. 4*a* in a second position.

The user determines the amount of material to be removed by the tool 56, and sets the tool 56 accordingly. Once this distance is determined, the user can set the adjustment block 36 of the stair step structure to correspond to this particular distance. As an example, and referring to FIGS. 4*a* and 4*b*, if the block of material is to be trimmed by 1/16 of an inch, and the depth of each notch 38 varies by 1/32 of an inch, then the user can grasp the gripping segment 42 and slide the adjustment block 36 from the furthest back position with the notch engaging fins 40 engaging notches 38*a* until the notch engaging fins 40 engage the appropriate notches 38*c*. Once so positioned, the out-feed fence block 20*b* can extend outwardly away from the second mounting surface 16 approximately 1/16 of an inch farther than the in-feed fence block 20*a*. The user can then tighten fasteners 24 to firmly hold the out-feed fence block 20*b* in position, and can position the block of material to be trimmed against the in-feed fence block 20*a*. The section of material can then be fed along the in-feed fence block 20*a* towards the stationary router or other tool 56, where it can be trimmed, and then continues to the out-feed fence block 20*b*.

As the router or other tool trims the section of material, the portion of the block of material not yet trimmed is actually 1/16 of an inch wider than the portion of the material already trimmed. Significantly, however, once the trimmed portion of the block of material reaches the out-feed fence block 20*b* of the present router fence 10, the block of material will not seesaw. The seesaw effect is curtailed because the trimmed portion of the block of material will be pressed up against the out-feed fence block 20*b* when it reaches the out-feed fence block 20*b*, as the outwardly adjusted (by 1/16 of an inch) out-feed fence block 20*b* compensates for the loss of the portion of the material block removed by the router.

It will be understood that the user does not have to carefully measure the differences in the positions of the in-feed and out-feed fence blocks, but can simply choose the notch that corresponds to the desired trimming distance. The trimming distance may be marked on the top of the vertical mounting surface, or may be included in any suitable place. This enables a user is able to set the guide fence to the correct position quickly and easily.

The present invention has been described with the use of an adjustment block and stair step structure for performing the incremental movement of the out-feed fence block. However, any suitable means of performing an incremental adjustment in distance may be employed. A stair step structure may be located between the fence block and the mounting surface without the need for an intervening adjustment block. For example, the notch engaging fins may be provided directly on the fence block. It is also not necessary to include a stair step structure, as incremental movement of the position of the fence block may be achieved using the movement of a pin along a notched groove, a stepped cam, a ratchet and pawl mechanism, or with any other suitable mechanism. In another embodiment, grooves or notches for receiving and setting the position of the fence block may be located in a horizontal mounting surface underneath the fence block, rather than the vertical mounting surface.

The illustrated embodiment is described in use with a power tool such as a router. However, it will be appreciated that the invention is useful in acting as a guide for many different types of tools. As examples, the invention is useful for guiding a workpiece to a hand tool, and may be used with a sander, circular saw, miter saw, spindle shaper, any other table-mounted tool, and any other suitable tool.

It should be understood that the examples and embodiments described herein are for illustrative purposes only and that various modifications or changes in light thereof will be suggested to persons skilled in the art and are to be included within the spirit and purview of this application. The invention can take other specific forms without departing from the spirit or essential attributes thereof.

What is claimed is:

1. A guide for a tool comprising:

a support structure having at least one mounting surface;

a fence portion coupled to said mounting surface;

an adjustment structure for positioning said fence portion at one of a plurality of predetermined distances from said mounting surface; and at least one coupling for coupling said fence portion to said mounting surface and for holding said fence portion at said predetermined distance from said mounting surface, wherein said adjustment structure comprises an adjustment block located between said mounting surface and said fence portion.

2. A guide comprising:

a support structure having at least one mounting surface;

a fence portion coupled to said mounting surface;

an adjustment structure for positioning said fence portion at one of a plurality of predetermined distances from said mounting surface: and at least one coupling for coupling said fence portion to said mounting surface and for holding said fence portion at said predetermined distance from said mounting surface;

wherein the adjustment structure comprises a stair step structure positioned between said mounting surface and said fence portion.

3. The guide according to claim 2, wherein the stair step structure is cut into said mounting surface.

4. The guide according to claim 2, wherein the stair step structure includes a plurality of notches of different predetermined depths.

5. The guide according to claim 4, wherein adjoining notches have incrementally greater depths.

6. The guide according to claim 4, wherein each notch varies in height approximately 1/32 of an inch.

7. The guide according to claim 4, wherein the adjustment structure includes a notch-engaging fin for alignment with at least one of the plurality of notches.

8. The guide according to claim 7, wherein the stair step structure includes a plurality of sets of notches and a plurality of notch-engaging fins.

9. The guide according to claim 7, wherein said adjustment structure further comprises an adjustment block, and wherein said notch-engaging fin is provided on said adjustment block.

10. The guide according to claim 8, wherein said adjustment block has a gripping portion.

11. The guide according to claim 1;

wherein said support structure has a horizontal surface for coupling to a work surface; and wherein said mounting surface is substantially perpendicular to said horizontal surface.

12. The guide according to claim 1, wherein said at least one coupling is a bolt passing through said mounting surface, said adjustment structure and said fence portion.

13. The guide according to claim 12, wherein said adjustment structure and said fence portion have elongated apertures through which said bolts can pass.

14. The guide according to claim 13, wherein said elongated apertures in said fence portion are countersunk.

15. The guide according to claim 1, wherein at least one of said mounting surface and said adjustment structure is formed of metal.

16. The guide according to claim 1, wherein said fence portion at least partially comprises wood.

17. A guide for a tool, comprising:

a support structure having at least one mounting surface;

an in-feed fence portion coupled to said mounting surface for guiding a workpiece to a tool;

an out-feed fence portion coupled to said mounting surface for guiding a workplace from the tool;

an adjustment structure comprising an adjustment block provided between said at least one mounting surface and said out-feed fence portion for positioning said out-feed fence portion at one of a plurality of predetermined distances from said mounting surface; and coupling structure for coupling said fence portions to said mounting surface and for holding said out-feed fence portion at said predetermined distance from said mounting surface.

18. A guide for a tool, comprising:

a support structure having at least one mounting surface;

an in-feed fence portion coupled to said mounting surface for guiding a workpiece to a tool;

an out-feed fence portion coupled to said mounting surface for guiding a workpiece from the tool;

an adjustment structure for positioning said out-feed fence portion at one of a plurality of predetermined distances from said mounting surface; and coupling structure for coupling said fence portions to said mounting surface and for holding said outfeed fence portion at said predetermined distance from said mounting surface, wherein said adjustment structure comprises a stair step structure positioned between said mounting surface and said out-feed fence portion.

19. The guide according to claim 18, wherein the stair step structure is cut into said mounting surface.

20. The guide according to claim 18, wherein the stair step structure includes a plurality of notches of different predetermined depths.

21. The guide according to claim 20, wherein adjoining notches have incrementally greater depths.

22. The guide according to claim 20, wherein each notch varies in height approximately 1/32 of an inch.

23. The guide according to claim 20, wherein the adjustment structure includes a notch-engaging fin for alignment with at least one of the plurality of notches.

24. The guide according to claim 23, wherein the stair step structure includes a plurality of sets of notches and a plurality of notch-engaging fins.

25. The guide according to claim 23, wherein said adjustment structure further comprises an adjustment block and wherein said notch-engaging fin is provided on said adjustment block.

26. The guide according to claim 25, wherein said adjustment block has a gripping portion.

27. The guide according to claim 17, wherein said support structure is L-shaped, and has a horizontal surface for coupling to a work surface; and wherein said mounting surface is substantially perpendicular to said horizontal surface.

28. The guide according to claim 17, wherein said couplings comprise bolts passing through said mounting surface, said adjustment structure and said fence portion.

29. The guide according to claim 28, wherein said adjustment structure and said out-feed fence portion have elongated apertures throughout which said bolts can pass.

30. The guide according to claim 29, wherein said elongated apertures in said out-feed fence portion are countersunk.

31. The guide according to claim 17, wherein at least one of said mounting surface and said adjustment structure is formed of metal.

32. The guide according to claim 17, wherein said fence portion at least partially comprises wood.

33. The guide according to claim 17, wherein said mounting surface has a cut-out portion for receiving the tool between said in-feed fence portion and said out-feed fence portion.

34. The guide according to claim 33, wherein said cut-out portion has a removable plate.

35. A work table for a tool, the work table having a guide, said guide comprising:

a support structure attached to the work table and having at least one mounting surface;

an in-feed fence portion coupled to said mounting surface for guiding a workpiece to a tool;

an out-feed fence part coupled to said mounting surface for guiding a workpiece from the tool;

an adjustment structure comprising an adjustment block provided between said at least one mounting surface and said outfeed fence portion for positioning said out-feed fence portion at one of a plurality of predetermined distances from said mounting surface; and couplings for coupling said fence portion to said mounting surface and for holding said out-feed fence portion at said predetermined distance from said mounting surface.

36. An adjustment structure for a guide for a tool, the guide having a mounting surface and a fence portion, the adjustment structure comprising:

an adjustment block for insertion between said mounting surface and said fence portion, the adjustment block having adjustment structure for positioning said fence portion at one of a plurality of predetermined distances from said mounting surface.

37. The adjustment structure of claim 36, wherein said adjustment structure comprises a stair step structure positioned between said mounting surface and said fence portion.

38. The guide according to claim 37, wherein the adjustment block includes a notch-engaging fin for locating in one of a plurality of notches cut into said mounting surface.

39. The guide according to claim 38, wherein the stair step structure includes a plurality of sets of notches and a plurality notch-engaging fins.

40. The guide according to claim 36, wherein said adjustment block has a gripping portion.

41. A method of guiding a workpiece from a tool, comprising the steps of:

providing a support structure and having a mounting surface;

coupling a fence portion to said mounting surface for guiding a workpiece from the tool;

setting an adjustment structure in order to position said fence portion at one of a plurality of predetermined distances from said mounting surface; and holding said fence portion at said predetermined distance from said mounting surface, wherein said step of setting an adjustment structure comprises moving a stair step structure between a first position and a second position, the stair step structure including a plurality of notches of different predetermined depths.

* * * * *